US005322030A

United States Patent [19]

Brehmer

[11] Patent Number: 5,322,030

[45] Date of Patent: Jun. 21, 1994

[54] FLOATING TRANSOM EXTENSION ASSEMBLY

[76] Inventor: T. Ric Brehmer, 1859 Opa Locka Blvd., Opa Locka, Fla. 33054

[21] Appl. No.: 88,870

[22] Filed: Jul. 8, 1993

[51] Int. Cl.[5] ..... B63B 5/12

[52] U.S. Cl. ..... 114/343; 440/61; 440/900; 248/641

[58] Field of Search ..... 440/61, 900; 114/362, 114/343; 248/640-643

[56] References Cited

U.S. PATENT DOCUMENTS

| | | | |
|---|---|---|---|
| 570,613 | 11/1896 | Smith . | |
| 2,842,086 | 7/1958 | Yost | 248/641 |
| 4,232,627 | 11/1980 | Glenn et al. | 248/641 |
| 4,482,330 | 11/1984 | Cook | 440/61 |
| 4,624,438 | 11/1986 | Goodman, Jr. | 440/61 |
| 4,669,414 | 6/1987 | Molino | 114/362 |
| 4,682,961 | 7/1987 | Nakahama | 440/61 |
| 4,842,559 | 6/1989 | Litjens et al. | 440/61 |
| 4,861,292 | 8/1989 | Griffiths et al. | 440/61 |
| 4,890,811 | 1/1990 | Ehni | 440/61 |
| 4,895,095 | 1/1990 | Potter, Jr. | 440/900 |
| 4,907,993 | 3/1990 | Thompson | 440/61 |
| 5,041,032 | 8/1991 | Makihara et al. | 440/900 |
| 5,100,349 | 3/1992 | Perkins et al. | 440/6 |

OTHER PUBLICATIONS

Evinrude® Outboards "OceanPro" brochure, 1992, Outboard Marine Corporation.

Johnson FastStrike 175, "Porta-Bracket" brochure, Bob's Machine Shop.

"Hydraulic Transom Jack Kit" brochure, Bob's Machine Shop.

OMC "SeaDrive" brochure.

Stainless Marine "Performance Transom-Brackets TM" brochure.

Altus "Trim & Tilt" brochure.

Altus "Trim & Tilt" Model AL 55 brochure.

Land & Sea, Inc. ®, "Outboard Performance Accessories", 1992 Catalog.

*Primary Examiner*—Jesus D. Sotelo

*Attorney, Agent, or Firm*—Leslie J. Lott & Assoc.

[57] ABSTRACT

A floating transom extension assembly is disclosed. The present invention provides a transom extension assembly for adjustably positioning an outboard motor upon a boat, comprising a floating transom extension, a motor mounting plate slidably coupled to the transom extension, apparatus for mounting the transom extension to the stern of the boat, apparatus for mounting the outboard motor to the motor mounting plate, and apparatus for adjusting the position of the motor mounting plate relative to the transom extension. In an alternative embodiment, the transom extension assembly further comprises a platform extending outwardly over the sides and rearwardly in a U-shape around the motor providing easy access to the motor and further providing the convenience of a stern mounted platform for entry into and exit from the stern of the boat. In a further alternative embodiment, the transom extension assembly is configured for more than one outboard motor attached to the stern of the boat.

20 Claims, 6 Drawing Sheets

FLOATING TRANSOM EXTENSION ASSEMBLY

TECHNICAL FIELD

This invention relates generally to a floating transom extension assembly with an integral adjustable outboard motor bracket, and this invention specifically relates to a floating transom extension assembly with an integral adjustable outboard motor bracket to modify the position of the outboard motor relative to the transom of an associated boat and to provide added flotation to the aft end of the boat.

BACKGROUND OF THE INVENTION

The drive units for marine propulsion devices, including outboard motors and stern drives, are typically supported from the transom located as the stern of the boat by a mounting assembly. Various types of non-adjustable mounting assemblies are known, such as the boat propelling attachment described in U.S. Pat. No. 570,613 to Smith, incorporated herein by reference. Although an outboard motor mounted directly on the boat transom may be trimmed by tilting, a non-adjustable mount restricts the amount of vertical movement of the outboard motor. To overcome this problem, adjustable mounting assemblies have been invented which not only allow for more vertical movement and trim, but also position the motor aft of the stern of the boat, thus improving high speed handling. These transom extension mounting assemblies are mounted to the transom of the boat supporting the outboard motor aft of the boat transom. The relocation of the motor aft of the transom improves the high speed handling characteristics of most boats. This also improves the maneuverability of slow speed turning and docking, resulting in drastic improvements for the operator and safety of the passengers. Transom extension mounting assemblies are used increasingly on high performance boats powdered by outboard motors, where a lower position of the motor improves initial boat acceleration and a higher position enhances top speed by reducing gear case drag, and draft, thereby enhancing shallow water performance. The raising of the motor while underway enhances a steadier, more stable ride allowing the cutting edge of the hull to perform as its engineered design. In short, transom extensions increase fuel economy, provide less drag, increase rpm's and horsepower.

One type of transom extension mounting assembly comprises a parallelogram linkage arrangement between the motor and the transom of the boat. Such systems are generally described in U.S. Pat. No. 4,890,811 to Ehni; U.S. Pat. No. 4,682,961 to Nakahama; U.S. Pat. No. 4,861,292 to Griffiths, et al.; and U.S. Pat. No. 4,842,559 to Litjens et al.; all of which are incorporated herein by reference.

The transom extension mounting assembly of the Ehni patent generally describes a mounting device positioned between the boat and the outboard motor including a parallelogram linkage having a front bracket for securement to the transom and a rear bracket on which the outboard motor is secured. For raising and lowering the parallelogram linkage and outboard motor mounted thereon, a hydraulic cylinder is secured to the front bracket and an extending piston rod is mounted on the rear bracket. Upon acceleration, when the bow of the boat tends to rise, the desired boat ride angle may be adjusted by raising or lowering the parallelogram linkage. Also, in shallow water, the outboard motor may be raised so that the propeller is above the lower surface of the boat.

The transom extension mounting assembly of the Nakahama patent describes a parallelogram linkage for trimming the propeller and tilting the motor up, without increasing the effective length of the water craft.

Another type of mounting assembly comprises a slidably mounted motor mounting plate. Such systems are generally described in U.S. Pat. No. 4,907,993 to Thompson; U.S. Pat. No. 4,482,330 to Cook; U.S. Pat. No. 4,232,627 to Glenn et al.; U.S. Pat. No. 4,624,438 to Goodman, Jr.; and U.S. Pat. No. 5,100,349 to Perkins et al., all of which are incorporated herein by reference.

The mounting assembly of the Thompson patent generally describes an apparatus for mounting an outboard motor including a transom bracket and motor mounting plate slidably mounted in channels located on the inside surface of the rearwardly extending side plates of the transom bracket. A waterproof marine electromechanical unit having an activating rod secured to the mounting plate raises and lowers the mounting plate.

However, there are problems associated with each of these type of mounting assemblies.

A first problem is with mounting assemblies which mount on outboard motor directly on a boat transom at a fixed height. These types of mounting assemblies do not allow any of the benefits of vertical movement of the motor, other than the limited movement inherent in the trimming operation.

The parallelogram linkage assemblies used for raising and lowering the outboard motor, or for tilting and trimming the outboard motor have the disadvantage of causing increased weight near the stern of the boat, an effect which decreases the performance of the water craft by causing the stern of the boat to sit lower in the water, not only during idle conditions, but also during operation. The lower stern position causes the outboard motor to add increased drag and resistance, the very problem which the transom extension mounting assembly is trying to overcome. During any running speeds, this type of assembly causes the boat to squat towards the aft of the boat where the outboard motor is mounted, making a large wake which is unsafe for passing boats, and causes the bow to raise, blocking the operators view. This same disadvantage arises in the motor mounting assemblies in which the motor mounting plate is slidably mounted on a transom bracket.

An additional problem with parallelogram linkage mounting assemblies is that the parallelogram linkage assembly has numerous exposed moving parts, subject to salt water corrosion due to continuous contact with the salt water and air. In addition, the exposed assembly fails to provide protection for the hydraulic cylinder or other control systems.

A further problem exists with parallelogram linkage mounting assemblies regarding personal safety. An operator's or passenger's hands or feet may become trapped during the adjustment of the moving arms of the parallelogram linkage, especially when attempting to work on the outboard motor or climbing into the stern of the boat.

An additional problem arises in that none of the above-mentioned systems have a bottom panel on the transom bracket, therefore they fail to provide any protection from splashing and water intrusion into the boat during operation and especially while backing down during fishing. A bottom panel is a major factor in preventing the boat from squatting when underway and preventing the carburetors from becoming swamped.

Another problem arises with the above-mentioned systems when an operator needs to access the motor, since there is no top surface area on the mounting assemblies upon which the operator may sit or stand. This problem often results in the operator having to enter the water, even for minor maintenance.

Another problem is that the above-mentioned systems lack a top mounted platform, beneficial for both the operator accessing the motor and for swimmers and the like entering the boat.

Another problem is that since the above-mentioned systems do not provide any flotation near the stern of the boat, an operator would be detoured from standing near the transom to take the engine cowling off to check for an obvious mechanical failure. Without flotation, the additional weight of an adult may cause the powerhead to become swamped and damaged with the cowling removed.

One possible solution to these problems is to provide a system wherein the transom extension assembly adds flotation to the stern of the boat rather than added weight, to provide compensation for the weight of the motor.

Another possible solution to these problems is to provide a system with no exposed critical moving parts or control devices which could corrode or become damaged due to the salt water and air.

Another possible solution to these problems is to provide a system wherein the chance of an operator or passenger becoming injured during routine motor maintenance or climbing into the boat is reduced.

Another possible solution to these problems is to provide a system wherein vertical movement of the outboard motor is accomplished by installation of a simple, streamlined, color-coordinated integral unit, adapted for use on most boat transoms which does not detract from the aesthetic appearance of the boat.

Another possible solution to these problems is to provide a system wherein a bottom panel to the transom extension is provided to reduce splashing and water intrusion into the stern of the boat, preventing the boat from squatting while underway, and preventing the carburetors from becoming swamped.

Another possible solution to these problems is to provide a system wherein an operator can access the motor without entering the water by sitting on a top surface of the mounting assembly.

Another possible solution to these problems is to provide a system with a top mounted platform, beneficial for both the operator accessing the motor and for swimmers and the like entering the boat.

Another possible solution to these problems is to provide a system with flotation near the stern of the boat, so that an operator may stand near the transom to take the engine cowling off and check for an obvious mechanical failure without the fear of swamping the powerhead. A system provided with flotation near the stern of the boat would also aid in rope starting the engine.

Thus, there has been a need in the art for a system that provides flotation near the stern of the boat rather than added weight, to compensate for the weight of the motor.

There is an additional need in the art for a system in which no exposed critical moving parts or control devices are subject to corrosion or become damaged due to the salt water and air.

There is an additional need in the art for a system which does not increase the chance of an operator or passenger becoming injured during routine motor maintenance or climbing into the boat.

There is an additional need in the art for a system which provides vertical movement of the outboard motor through installation of a simple, streamlined, color-coordinated integral unit, adapted for use on most boat transoms, which does not detract from the aesthetic appearance of the boat.

There is an additional need in the art to provide a system wherein a bottom panel to the transom extension is provided to reduce splashing and water intrusion into the stern of the boat, prevent the boat from squatting while underway, and prevent the carburetors from becoming swamped and stalling the motor, especially during heavy sea conditions.

There is an additional need in the art to provide a system which allows easy access to the motor by allowing the operator to sit or stand on a top surface of the mounting assembly.

There is an additional need in the art to provide a system with a top mounted platform for use by both the operator and others in accessing the motor or entering the boat.

SUMMARY OF THE INVENTION

The present invention solves significant problems in the art by providing a transom extension assembly for adjustably positioning an outboard motor upon a boat. Generally described, the present invention provides a transom extension assembly for adjustably positioning an outboard motor upon a boat, comprising, a floating transom extension; a motor mounting plate slidably coupled to the transom extension; means for mounting the transom extension to the stern of the boat; means for mounting the outboard motor to the motor mounting plate; and means for adjusting the position of the motor mounting plate relative to the transom extension.

The floating transom extension comprises a top panel, a bottom panel, and two side panels extending between a transom mounting plate and a receiving plate, the panels are secured together and to the plates to form a substantially parallelogram shaped air-tight compartment. The transom extension assembly further comprises a means for accessing the compartment. The receiving plate comprises a means for slidably coupling the receiving plate to the motor mounting plate. The slidably coupling means includes a tubular member and a channel member attached to the receiving plate for slidably coupling the receiving plate to the motor mounting plate.

The motor mounting plate comprises a substantially rectangular shaped plate, having a forward face and a rearward face, the rearward face including a means for mounting the motor onto the motor mounting plate, and the forward face including a means for slidably coupling the motor mounting plate to the receiving plate of the floating transom extension. The means for mounting the motor comprises a series of apertures within the rearward face alignably engaged by a series of bolts for mounting the motor onto the rearward face. The means for slidably coupling includes a tubular member and a channel member attached to the forward face for slidably coupling the forward face to the floating transom extension.

The means for mounting the floating transom extension to the stern of the boat comprises a series of apertures within the transom mounting plate alignably engaged by a series of bolts to the stern of the boat. The adjusting means comprises a hydraulically actuated device which comprises a hydraulic cylinder attached to the motor mounting plate and a rod disposed in the hydraulic cylinder, wherein the rod is attached at one end to the receiving plate of the floating transom extension, a power means to move up and down the rod so as to effect movement of the motor mounting plate relative to the floating transom extension.

The transom extension assembly further comprises a platform, the platform extending outwardly over the side panels and rearwardly in a U-shape around the motor, whereby the platform provides easy access to the motor for maintenance and further provides added area for boat occupants to utilize during entry and exit from the boat.

An alternative embodiment of the invention provides a transom extension assembly for adjustably positioning a plurality of outboard motors upon a boat, comprising a floating transom extension; a plurality of motor mounting plates slidably coupled to the transom extension; means for mounting the transom extension to the stern of the boat; means for mounting the outboard motors to the motor mounting plates; and means for adjusting the position of the motor mounting plates relative to the transom extension. The floating transom extension comprises a top panel, a bottom panel, and two side panels extending between a transom mounting plate and a receiving plate, where the panels are secured together and to the plates to form a substantially parallelogram shaped air-tight compartment when mounted on the stern of the boat. The transom extension assembly further comprises a platform extending outwardly over said side panels and rearwardly in a U-shape around the motors, whereby the platform provides easy access to the motors for maintenance and further provides added area for boat occupants to utilize during entry and exit from the boat.

An alternative embodiment of the invention provides a transom platform assembly, comprising a substantially flat platform, having a top surface and a bottom surface, the platform extending outwardly over the sides of a transom and rearwardly in a U-shape around at least one motor, whereby the platform provides easy access to the motor for maintenance and further provides added area for boat occupants to utilize during entry and exit from the boat, and means for mounting the bottom surface of the platform to the transom.

Accordingly, it is an object of the present invention to provide a system wherein the transom extension assembly adds flotation to the stern of the boat rather than added weight, to compensate for the weight of the motor.

It is another object of the present invention to provide a system wherein vertical movement of the outboard motor is accomplished by installation of a simple, streamlined, color-coordinated integral unit, adapted for use on most boat transoms which does not detract from the aesthetic appearance of the boat.

Accordingly, it is a feature of the invention to provide a system with no exposed critical moving parts or control devices which could corrode or become damaged due to the salt water and air.

It is another feature of the invention to provide a system wherein the chance of an operator or passenger becoming injured during routine motor maintenance or climbing into the boat is reduced.

It is another feature of the invention to provide a system wherein a bottom panel to the transom extension is provided to reduce splashing and water intrusion into the stern of the boat, prevent the boat from squatting while underway, and prevent the carburetors from becoming swamped.

It is another feature of the invention to provide a system with a top mounted platform, beneficial for both the operator accessing the motor and for swimmers and the like entering the boat.

An advantage of the invention is that an operator can access the motor without entering the water by sitting or standing on a top surface of the mounting assembly.

These and other objects, features, and advantages of the present invention may be more clearly understood and appreciated from a review of the following detailed description of the disclosed embodiments and by reference to the appended drawings and claims.

BRIEF DESCRIPTION OF THE DRAWING FIGURES

DETAILED DESCRIPTION OF THE PREFERRED EMBODIMENT

Figure 1:
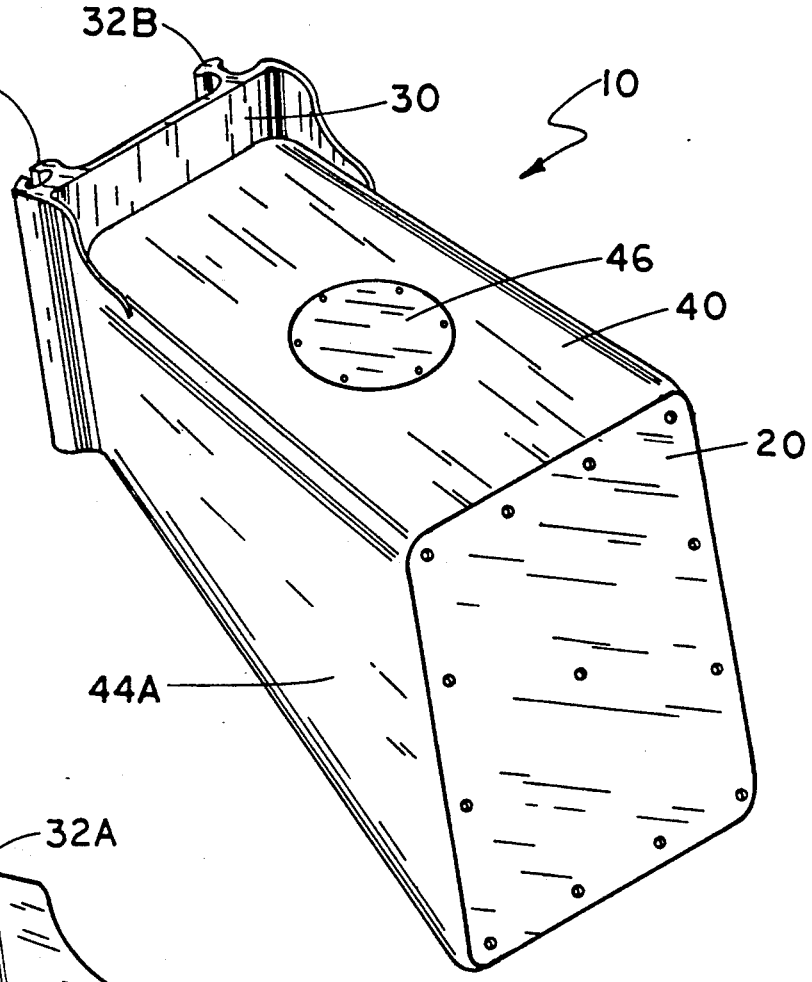
FIG. 1 is an elevated view of a preferred embodiment of the transom extension assembly showing the top and front sides of the floating transom without the motor mounting plate attached according to the invention.
Figure 2:
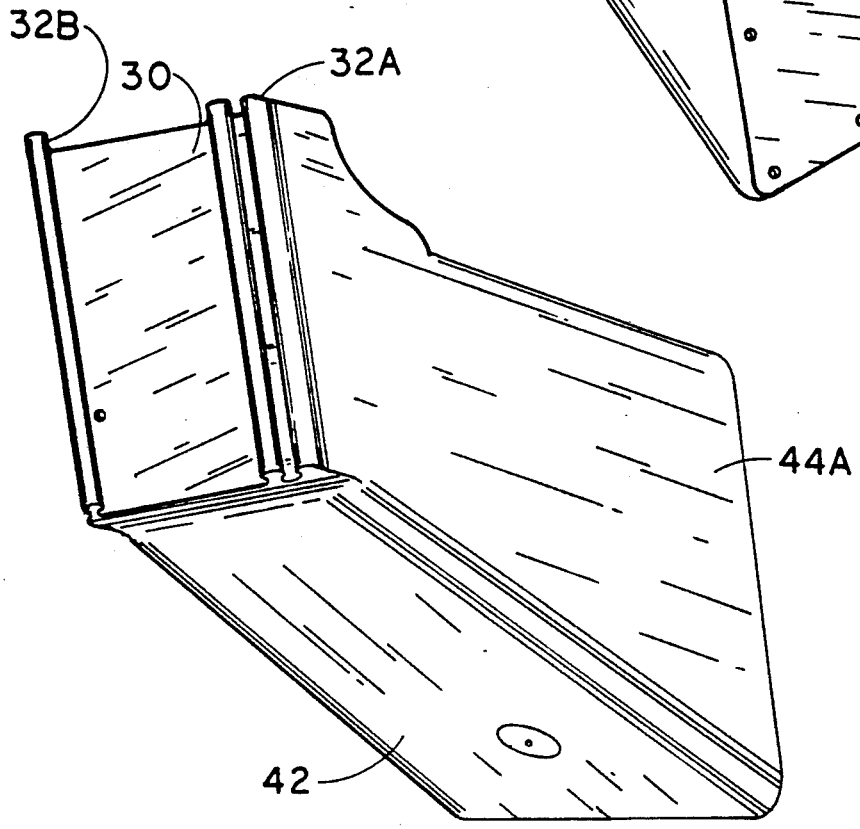
FIG. 2 is an elevated view of a preferred embodiment of the transom extension assembly showing the bottom and rear sides of the floating transom without the motor mounting plate attached according to the invention.

Referring initially to FIGS. 1 and 2 of the drawings, in which like numerals indicate like elements throughout the several views, in a preferred embodiment the floating transom extension of this invention is generally illustrated by reference numeral 10.

The floating transom extension 10 has a frontwardly located transom mounting plate 20 having a series of apertures through which it is rigidly mounted to the stern of the boat by means of bolts or the like. The transom extension 10 has a rearwardly located receiving plate 30 opposite the transom mounting plate 20 having a channel member 32*a*, and a tubular member 32*b* positioned vertically in a spaced relation on an outer face thereof.

The floating transom extension 10 has a top panel 40, a bottom panel 42, and two side panels 44*a* (shown) and 44*b* (not shown), extending between the transom mounting plate 20 and the receiving plate 30. Each of these panels, 40, 42, 44*a*, and 44*b*, are secured together in a substantially parallelogram shape, with the transom mounting plate 20 and the receiving plate 30 secured at either end, forming a sealed compartment inside. The receiving plate 30 extends slightly up over the top panel 40 to provide increased vertical movement of the motor. The sealed compartment is air tight, providing added flotation near the stern of the boat. An access means 46, such as a removable lid, is provided for permitting access to the sealed compartment 45. The bottom panel 42 is designed to reduce splashing and water intrusion into the stern of the boat, prevent the boat from squatting while underway, and prevent the carburetors from becoming swamped.

Figure 3:
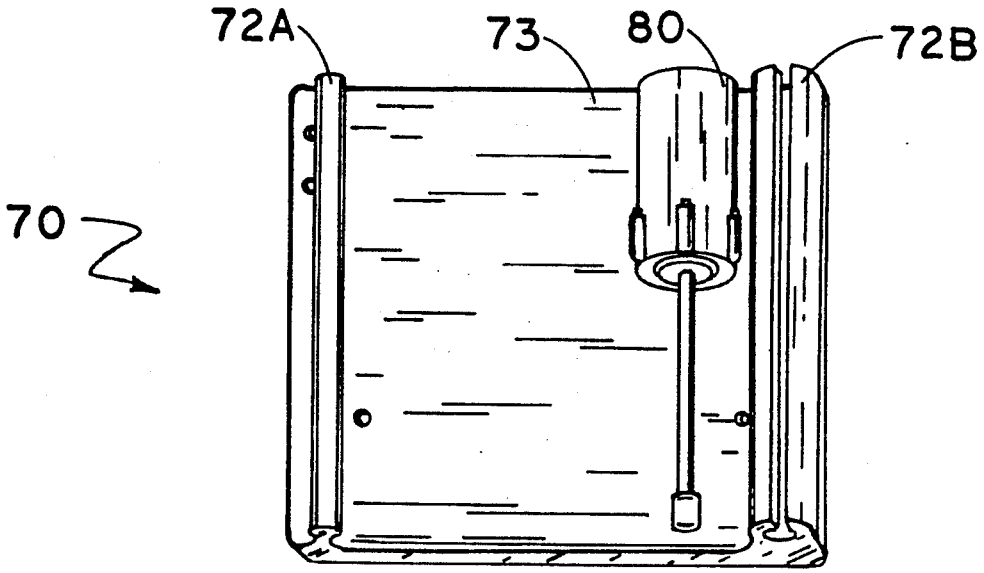
FIG. 3 is a front view of the motor mounting plate of the transom extension assembly of the preferred embodiment according to the invention.
Figure 4:
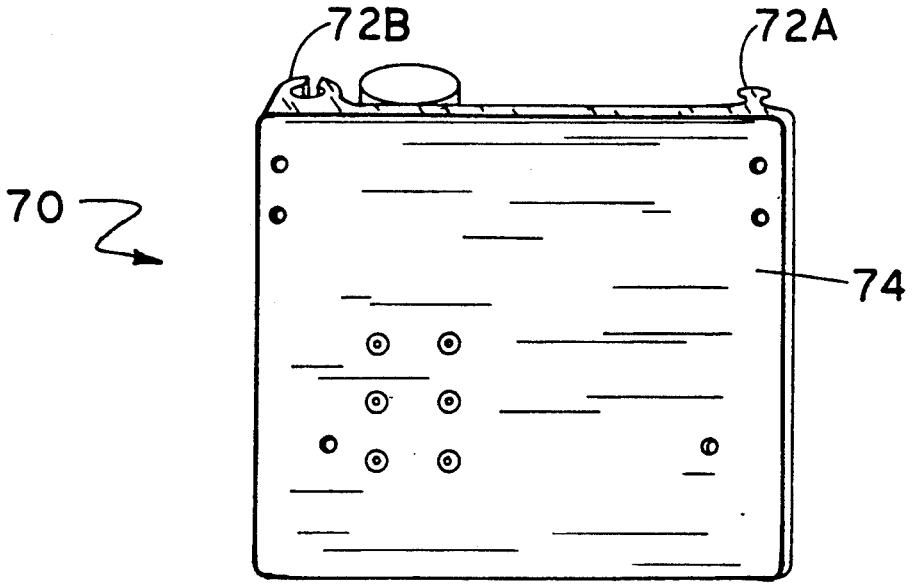
FIG. 4 is a rear view of the motor mounting plate of the transom extension assembly of the preferred embodiment according to the invention.

Referring now to FIGS. 3 and 4, a motor mounting plate 70 has a tubular member 72*a* and a channel member 72*b* positioned vertically in a spaced relation on a forward face 73 thereof. The positioning of these members is such that the tubular member 72*a* and channel member 72*b* directly correspond with the positioning of the channel member 32*a* and tubular member 32*b* of the receiving plate 30. The motor is mounted on the motor mounting plate 70 on a rearward face 74 thereof by means of bolts or the like. Adjustment of the motor mounting plate 70 and thereby adjusting of the attached outboard motor is achieved by an adjustment means 80, such as a hydraulic cylinder and piston assembly, coupled between the motor mounting plate 70 and the receiving plate 30 of the transom extension 10. A control means 85, such as an electronic switch wired to the adjustment means 80, is used to control the adjustment of the outboard motor.

Figure 5:
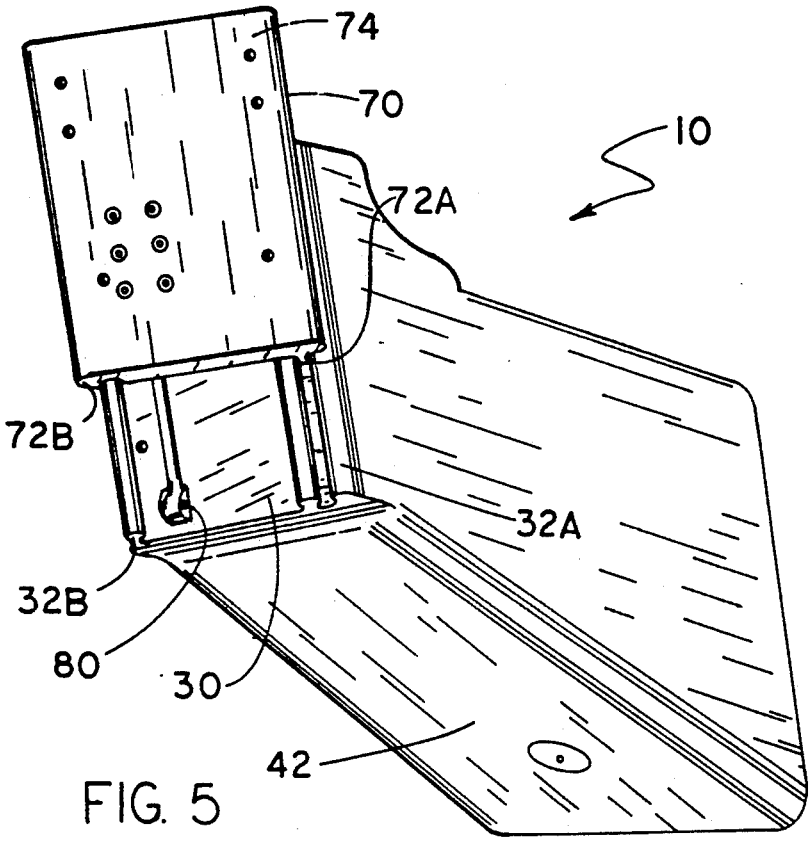
FIG. 5 is an elevated view of the transom extension assembly of the preferred embodiment according to the invention.
Figure 6:
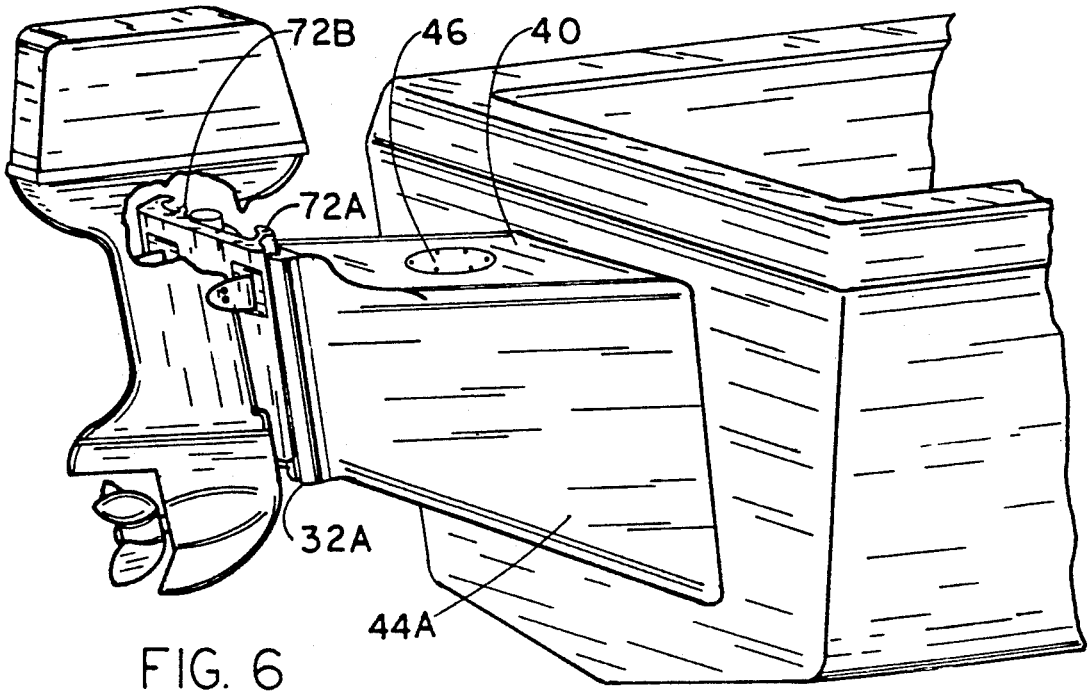
FIG. 6 is an elevated view of the transom extension assembly of the preferred embodiment shown mounted on the stern of a boat with the motor attached according to the invention.

The operation of the floating transom extension is best illustrated with reference to FIG. 5 and FIG. 6. The motor mounting plate 70 is slidably coupled to the receiving plate 30 by coupling the tubular member 72*a* and channel member 72*b* of the motor mounting plate 70 to the corresponding channel member 32*a* and tubular member 32*b* of the receiving plate 30. In this position, the motor mounting plate 70 is free to slide vertically in these channels, allowing the motor to be raised and lowered with respect to the transom. The motor mounting plate 70 is adjusted by the adjustment means 80, such as a hydraulic cylinder and piston assembly, coupled between the motor mounting plate 70 and the receiving plate 30 of the transom extension 10. The hydraulic cylinder, for instance, is mounted to the forward face 73 of the motor mounting plate 70 and its piston assembly is mounted to the receiving plate 30 of the transom extension 10. As the piston lengthens, the motor mounting plate 70 moves upward, raising the motor in relation to the transom. As the piston retracts, the motor mounting plate 70 moves downward, lowering the motor in relation to the transom. The movement is controlled by a control means, such as a switch located on the drive console or helm of the boat, connected to the adjustment means 80. When the boat is in shallow water, for example, the operator can adjust the vertical position of the motor by switching the control means. The motor will be lifted upward to the desired vertical position.

Figure 7:
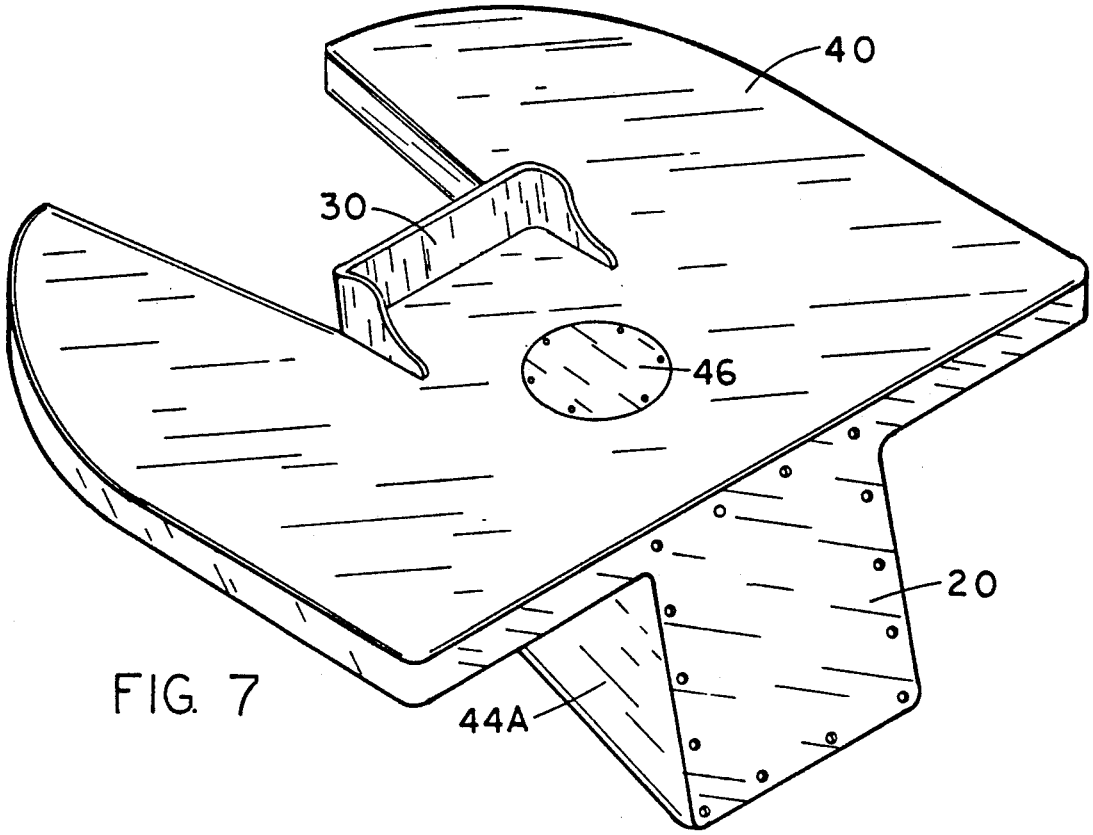
FIG. 7 is a top plan view of the transom extension assembly of an alternate embodiment showing a platform.

In an alternate embodiment of the present invention shown in FIG. 7, top panel 40 extends outwardly over the side panels 44*a*, 44*b* and rearwardly in a U-shape around the outboard motor forming a platform. The platform provides easy access to the outboard motor for routine maintenance, either while the boat is operating or while docked. The operator would not need to enter the water to work on the motor, since the platform provides a surface upon which the operator may sit or stand above the water. The platform would also provide added area for boat occupants, especially swimmers and skiers, to utilize during entry and exit from the boat, or for just sun bathing or relaxing.

Figure 8:
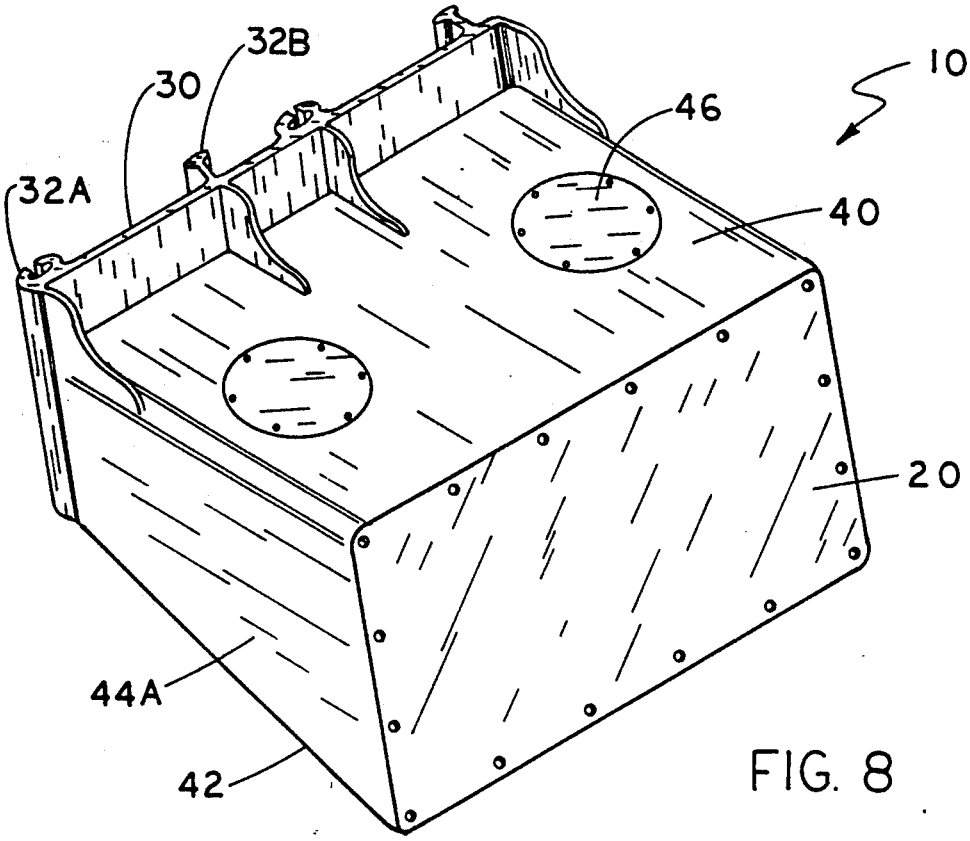
FIG. 8 is a top plan view of the transom extension of an alternate embodiment showing the configuration for a plurality of motors.

In an alternate embodiment of the present invention shown in FIG. 8, the transom extension assembly is configured for more than one outboard motor attached to the stern of the boat, for example, for a dual-transom extension assembly. The floating transom extension 10 has a frontwardly located transom mounting plate 20 having a series of apertures through which it is rigidly mounted to the stern of the boat by means of bolts or the like. This mounting plate may be solid or provided with a center opening. When the mounting plate 20 is mounted on the stern of the boat, the center opening will be sealed against the stern of the boat. The transom extension 10 has a rearwardly located receiving plate 30 opposite the transom mounting plate 20 having a plurality of channel members 32*a*, and tubular members 32*b* positioned vertically in a spaced relation on an outer face thereof.

The floating transom extension 10 has a top panel 40, a bottom panel 42, and two side panels 44*a* (shown) and 44*b* (not shown), extending between the transom mounting plate 20 and the receiving plate 30. Each of these panels, 40, 42, 44*a*, and 44*b*, are secured together in a substantially parallelogram shape, with the transom mounting plate 20 and the receiving plate 30 secured at either end, forming a compartment inside, which is sealed upon mounting the transom mounting plate 20 onto the stern of the boat. The receiving plate 30 extends slightly up over the top panel 40 to provide increased vertical movement of the motor. The sealed compartment is air tight, providing added flotation near the stern of the boat. An access means 46, such as a removable lid, is provided for permitting access to the sealed compartment 45.

Each of the motors are mounted on each of the motor mounting plates 70 on a rearward face 74 thereof by means of bolts or the like, as in the single motor embodiment. Adjustment of the motor mounting plates 70 and thereby adjusting of the attached outboard motors is achieved by adjustment means 80, such as hydraulic cylinders and piston assemblies, coupled between each of the motor mounting plates 70 and the receiving plate 30 of the transom extension 10. Control means 85, such as electronic switches wired to the adjustment means 80, are used to control the adjustment of the outboard motors.

Figure 9:
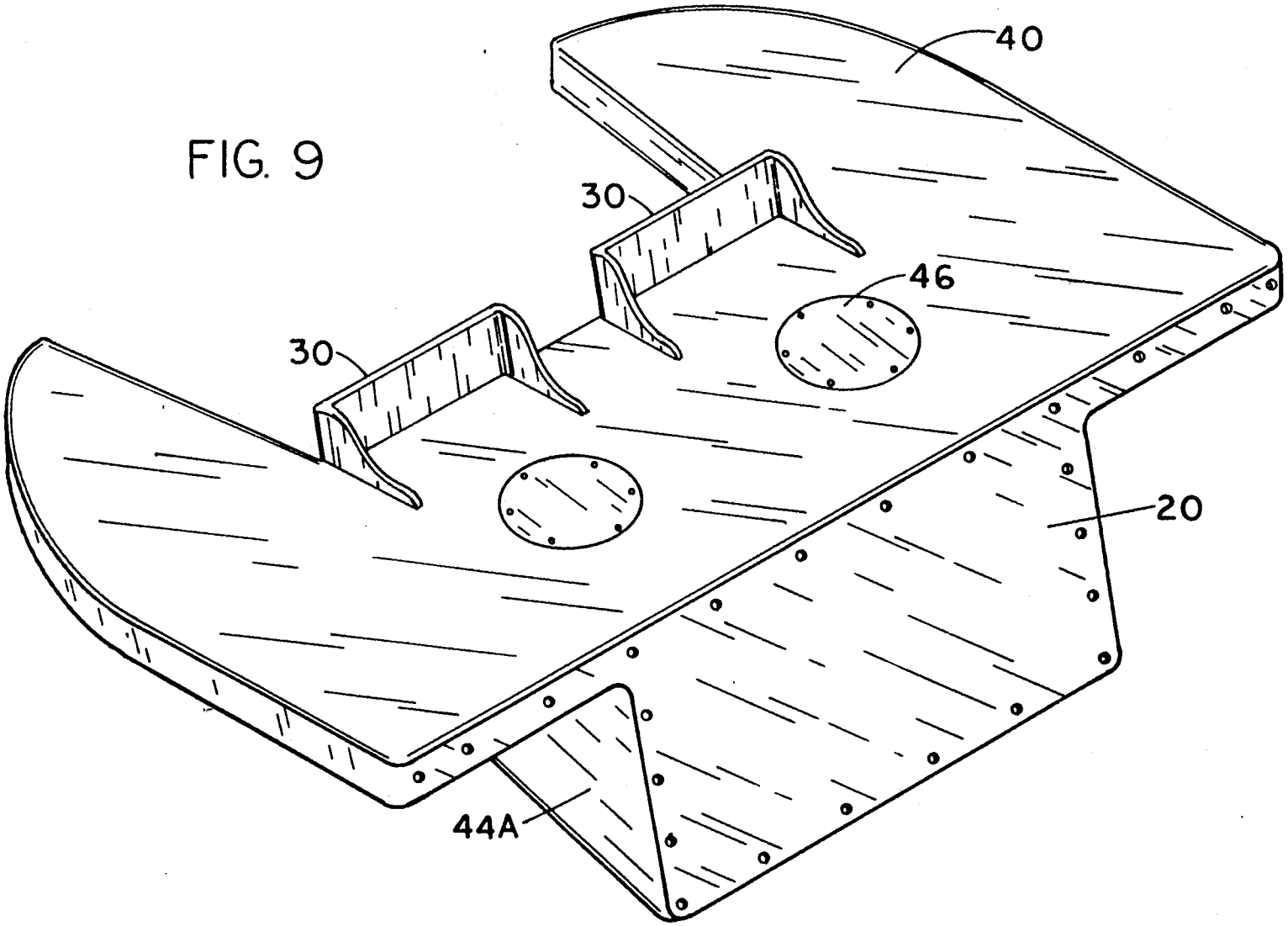
FIG. 9 is a top plan view of the transom extension assembly of an alternate embodiment showing the configuration for a plurality of motors and a platform.

In an alternate embodiment of the present invention, a platform as that described for use on a single motor transom extension assembly is provided for the transom extension assembly configured for a plurality of outboard motors of FIG. 8. The platform surrounds the outboard motors in a U-shape as seen in FIG. 9.

Figure 10:
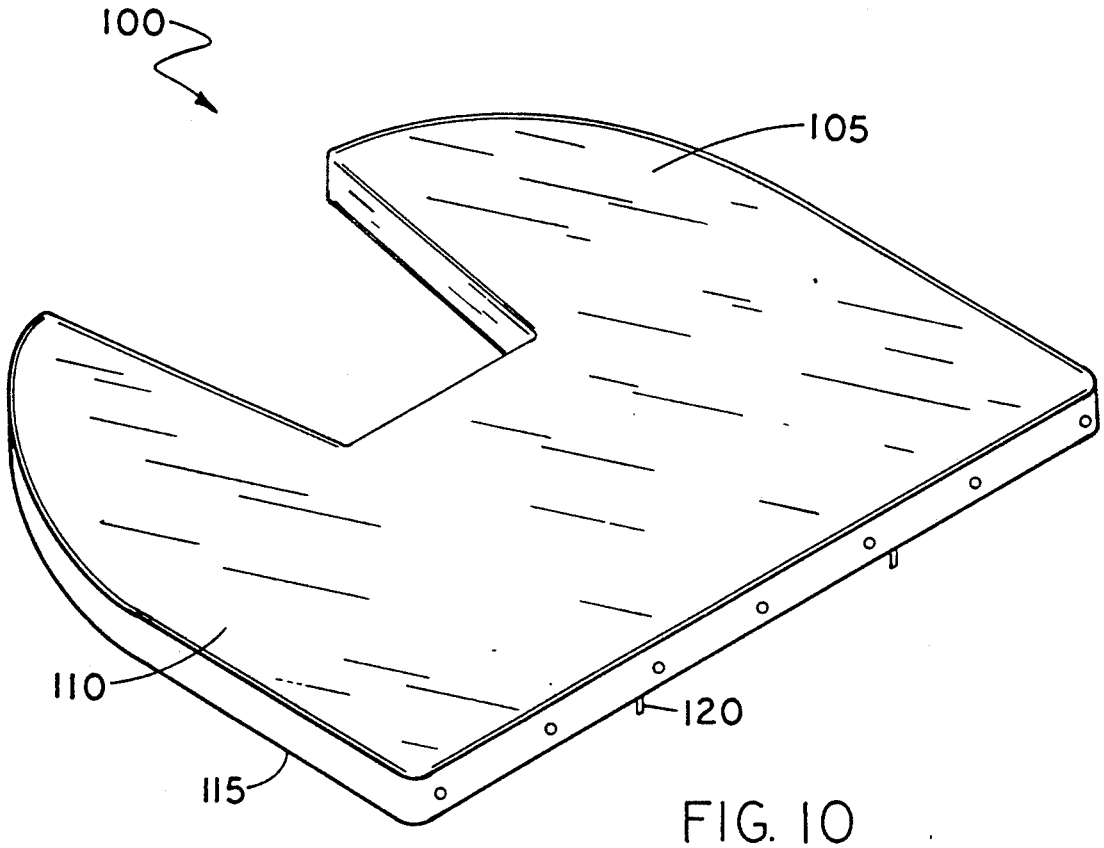
FIG. 10 is a top plan view of the platform assembly for use with multiple transom configurations.

FIG. 10 shows the platform assembly 100 as described above adapted for use with multiple transom configurations. The platform 105 extends outwardly over the sides of a transom and rearwardly in a U-shape around at least one motor. The platform 105 provides easy access to the motor for maintenance and further provides added area for boat occupants to utilize during entry and exit from the boat. The platform assembly 100 has a top surface 110 and a bottom surface 115 and includes a means for mounting 120 the bottom surface 115 of the platform 105 to a variety of transom configurations. In a preferred embodiment, the means for mounting includes a plurality of bolts, brackets, and the like for mounting the platform assembly 100 to the transom.

Figure 11:
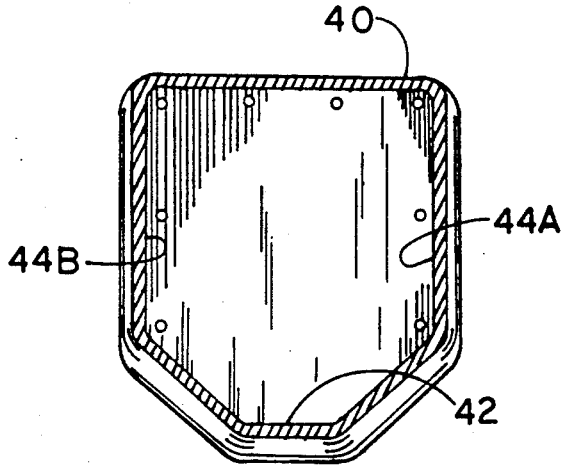
FIG. 11 is a cross-sectional view of the transom extension illustrating the design of the bottom panel in an alternative embodiment of the invention.

In an alternate embodiment of the present invention, FIG. 11 shows a cross-section of the transom extension 10 showing the bottom panel 42 extending downward in a substantially V-shaped design to facilitate greater lift to the stern of the boat, increasing the overall performance of the transom extension 10.

Accordingly, it will be understood that the preferred embodiment and alternative embodiment of the present invention have been disclosed by way of example and that other modifications and alterations may occur to those skilled in the art without departing from the scope and spirit of the appended claims.

What is claimed is:

1. A transom extension assembly for adjustably positioning an outboard motor upon a boat, comprising:

a floating transom extension comprising a top panel, a bottom panel, and two side panels extending between a transom mounting plate and a receiving plate, said panels secured together and to said plates to form a substantially parallelogram shaped air-tight compartment;

a motor mounting plate slidably coupled to said transom extension, comprising a substantially rectangular shaped plate, having a forward face and a rearward face, said rearward face including a means for mounting said motor onto said motor mounting plate comprising a series of apertures within said rearward face alignably engaged by a series of bolts for mounting said motor onto said rearward face, and said forward face including a means for slidably coupling said motor mounting plate to said receiving plate of said floating transom extension;

means for mounting said transom extension to the stern of said boat; and means for adjusting the position of said motor mounting plate relative to said transom extension.

2. The transom extension assembly of claim 1, further comprising a means for accessing said compartment.

3. The transom extension assembly of claim 1, wherein said receiving plate comprises a means for slidably coupling said receiving plate to said motor mounting plate.

4. The transom extension assembly of claim 3, wherein said slidably coupling means includes a tubular member and a channel member attached to said receiving plate for slidably coupling said receiving plate to said motor mounting plate.

5. The transom extension assembly of claim 1, wherein said means for slidably coupling includes a tubular member and a channel member attached to said forward face for slidably coupling said forward face to said floating transom extension.

6. The transom extension assembly of claim 1, wherein said means for mounting said floating transom extension to the stern of said boat comprises a series of apertures within said transom mounting plate alignably engaged by a series of bolts to said stern of said boat.

7. The transom extension assembly of claim 1, wherein said adjusting means comprises a hydraulically actuated device.

8. The transom extension assembly of claim 7, wherein said hydraulically actuated device comprises a hydraulic cylinder attached to said motor mounting plate and a rod disposed in said hydraulic cylinder, wherein said rod is attached at one end to said receiving plate of said floating transom extension, a power means to move up and down said rod so as to effect movement of said motor mounting plate relative to said floating transom extension.

9. The transom extension assembly of claim 1 wherein said bottom panel of said floating transom extension extends downward in a substantially V-shaped design to facilitate greater lift to said stern of said boat.

10. A transom extension assembly for adjustably positioning an outboard motor upon a boat, comprising:

a floating transom extension comprising a top panel, a bottom panel, and two side panels extending between a transom mounting plate and a receiving plate, said panels secured together and to said plates to form a substantially parallelogram shaped air-tight compartment;

a motor mounting plate slidably coupled to said transom extension;

means for mounting said transom extension to the stern of said boat;

means for mounting said outboard motor to said motor mounting plate;

means for adjusting the position of said motor mounting plate relative to said transom extension; and a platform, said platform extending outwardly over said side panels and rearwardly in a U-shape around said motor, whereby said platform provides easy access to said motor for maintenance and further provides added area for boat occupants to utilize during entry and exit from said boat.

11. A transom extension assembly for adjustably positioning a plurality of outboard motors upon a boat, comprising:

a floating transom extension, comprising a top panel, a bottom panel, and two side panels extending between a transom mounting plate and a receiving plate, said panels secured together and to said plates to form a substantially parallelogram shaped air-tight compartment when mounted on the stern of said boat;

a plurality of motor mounting plates slidably coupled to said transom extension, wherein each of said motor mounting plates comprises a substantially rectangular shaped plate, having a forward face and a rearward face, said rearward face including a means for mounting said motor onto said motor mounting plate comprising a series of apertures within said rearward face alignably engaged by a series of bolts for mounting said motors onto said rearward face, and said forward face including a means for slidably coupling said motor mounting plate to said receiving plate of said floating transom extension;

means for mounting said transom extension to the stern of said boat; and means for adjusting the position of said motor mounting plates relative to said transom extension.

12. The transom extension assembly of claim 11, further comprising a means for accessing said compartment.

13. The transom extension assembly of claim 11, wherein said receiving plate comprises a means for slidably coupling said receiving plate to said motor mounting plate.

14. The transom extension assembly of claim 13, wherein said slidably coupling means includes a tubular member and a channel member attached to said receiving plate for slidably coupling said receiving plate to said motor mounting plate.

15. The transom extension assembly of claim 11, wherein each of said motor mounting plates comprises a substantially rectangular shaped plate, having a forward face and a rearward face, said rearward face including a means for mounting said motor onto said motor mounting plate, and said forward face including a means for slidably coupling said motor mounting plate to said receiving plate of said floating transom extension.

16. The transom extension assembly of claim 15, wherein said means for slidably coupling includes a tubular member and a channel member attached to said forward face for slidably coupling said forward face to said floating transom extension.

17. The transom extension assembly of claim 11, wherein said means for mounting said floating transom extension to the stern of said boat comprises a series of apertures within said transom mounting plate alignably engaged by a series of bolts to said stern of said boat.

18. The transom extension assembly of claim 11, wherein said adjusting means comprises a hydraulically actuated device.

19. The transom extension assembly of claim 18, wherein said hydraulically actuated device comprises a hydraulic cylinder attached to said motor mounting plate and a rod disposed in said hydraulic cylinder, wherein said rod is attached at one end to said receiving plate of said floating transom extension, a power means to move up and down said rod so as to effect movement of said motor mounting plate relative to said floating transom extension.

20. A transom extension assembly for adjustably positioning a plurality of outboard motors upon a boat, comprising:

a floating transom extension comprising a top panel, a bottom panel, and two side panels extending between a transom mounting plate and a receiving plate, said panels secured together and to said plates to form a substantially parallelogram shaped air-tight compartment when mounted on the stern of said boat;

a plurality of motor mounting plates slidably coupled to said transom extension;

means for mounting said transom extension to the stern of said boat;

means for mounting said outboard motors to said motor mounting plates; and means for adjusting the position of said motor mounting plates relative to said transom extension;

a platform, said platform extending outwardly over said side panels and rearwardly in a U-shape around said motors, whereby said platform provides easy access to said motors for maintenance and further provides added area for boat occupants to utilize during entry and exit from said boat.

* * * * *